United States Patent [19]

McCall

[11] Patent Number: 4,915,596

[45] Date of Patent: Apr. 10, 1990

[54] PURE ROTARY POSITIVE DISPLACEMENT DEVICE

[76] Inventor: William B. McCall, 5 Clarita Ct., Novato, Calif. 94947

[21] Appl. No.: 261,422

[22] Filed: Oct. 24, 1988

[51] Int. Cl.[4] ..... F04B 1/20

[52] U.S. Cl. ..... 417/273; 417/462; 418/166

[58] Field of Search ..... 418/171, 166, 168, 170; 417/273, 462; 91/491, 493, 495; 123/246, 44 R

[56] References Cited

U.S. PATENT DOCUMENTS

| | | | |
|---|---|---|---|
| 728,157 | 5/1903 | Box | 418/171 |
| 1,166,999 | 1/1916 | Loftus | 123/246 |
| 1,183,309 | 5/1916 | Loftus | 91/493 X |
| 1,599,778 | 9/1926 | Loftus | 418/168 |
| 1,671,565 | 5/1928 | Astrom | 417/462 |
| 3,241,745 | 3/1966 | Williams | 417/462 |
| 3,367,275 | 2/1968 | Workman | 418/170 |
| 3,810,721 | 5/1974 | Eyer | 91/491 |
| 3,850,150 | 11/1974 | Plevyak | 123/246 |
| 4,030,458 | 6/1977 | Lamm | 417/462 |
| 4,057,367 | 11/1977 | Moe et al. | 417/273 |

FOREIGN PATENT DOCUMENTS

| | | | |
|---|---|---|---|
| 143521 | 6/1985 | European Pat. Off. | 417/462 |

OTHER PUBLICATIONS

Wilson, "Positive-Displacement Pumps", *Product Engineering,* Jun. 6, 1960, pp. 42–51.

Mahanay, "Gerotor Air Motor", *Machine Design,* Feb. 6, 1986, pp. 75–77.

*Primary Examiner*—Leonard E. Smith

*Attorney, Agent, or Firm*—Cahill, Sutton & Thomas

[57] ABSTRACT

A pure rotary positive displacement device includes a rotatably mounted circular cylindrical housing having an even number of equiangularly spaced, radial cylinders formed therein. A rotatably mounted piston carrier rotates in synchronization with the cylinder housing and supports at least one piston for movement within the cylinders. The central axis of the piston carrier is offset from the central axis of the cylinder housing, and each piston is spaced from the central axis of the piston carrier by the offset between the rotational axes of the piston carrier and the cylinder housing. The pistons and cylinders preferably have congruent conjugate surfaces to reduce leakage between the pistons and the cylinders, and the pistons are rotatably mounted to the piston carrier. The number of pistons is typically one-half the number of cylinders, and if multiple pistons are used, then they are spaced equiangularly about the piston carrier. When the device is designed to function as a pump or as a compressor, a fluid to be pumped or compressed is admitted to the cylinder housing and is forced from each cylinder as a piston advances toward the distal end thereof. A stationary cylinder head forms a sliding seal with the arcuate peripheral surface of the cylinder housing to exhaust fluid pumped, expanded or compressed by the pistons.

21 Claims, 5 Drawing Sheets

FIG. 1
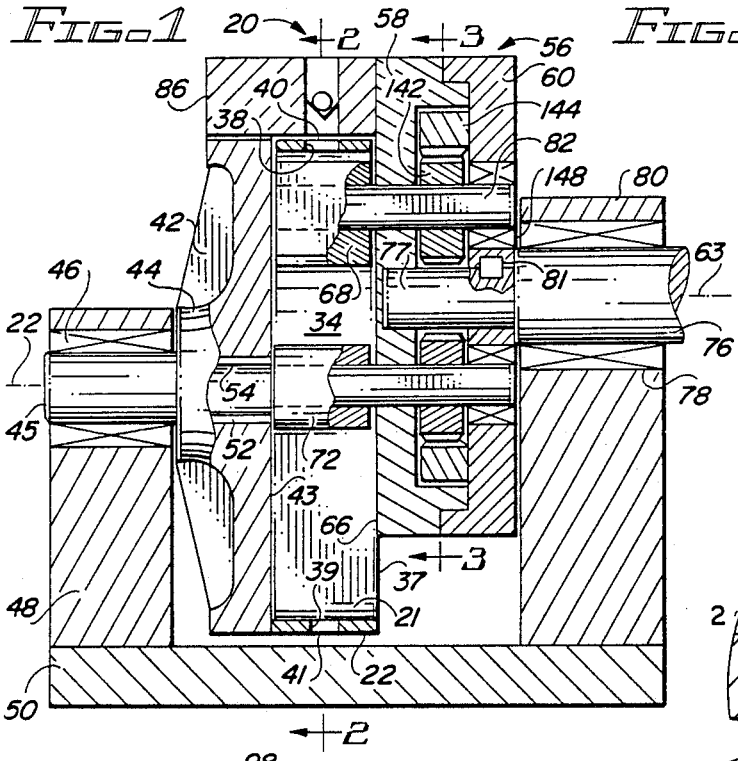
FIG. 6A
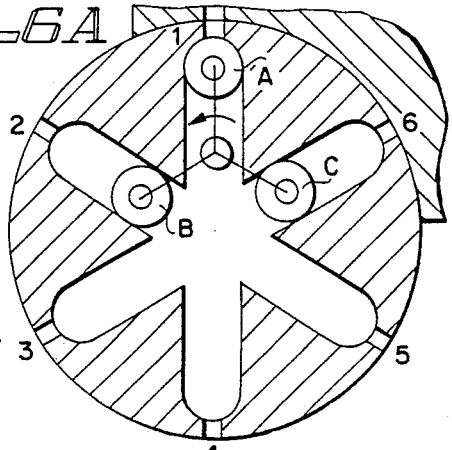
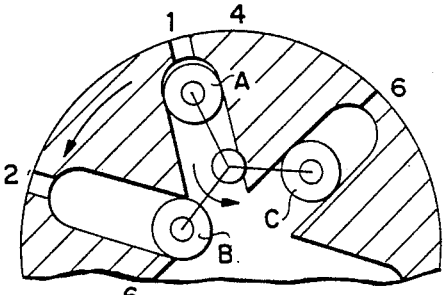
FIG. 6B
FIG. 2
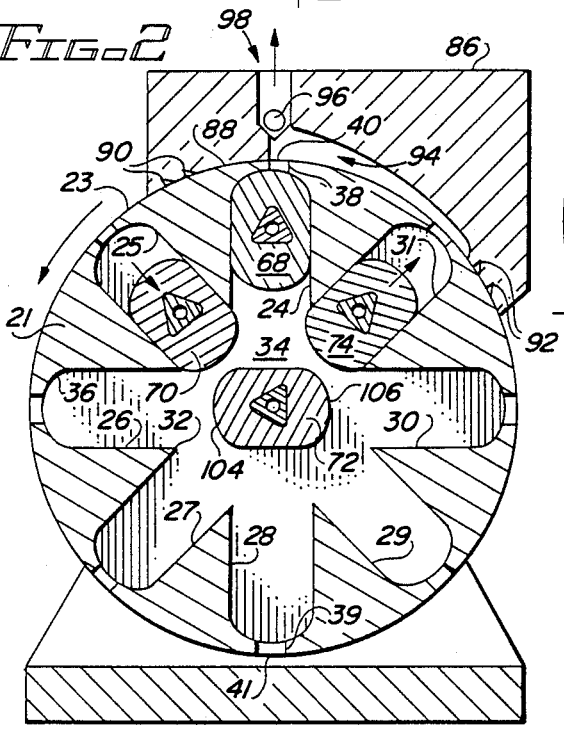
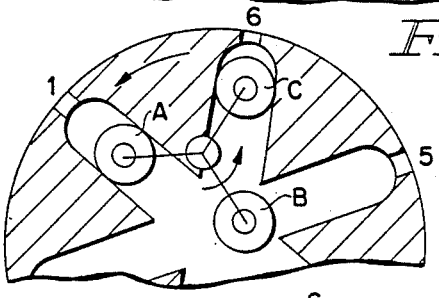
FIG. 6C
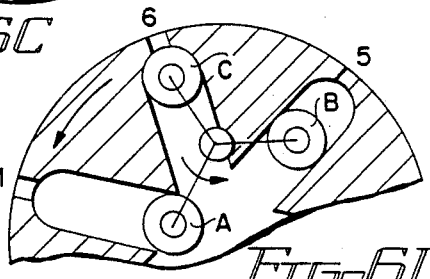
FIG. 6D
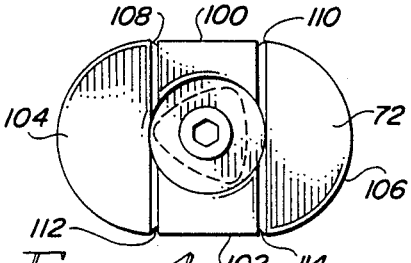
FIG. 4
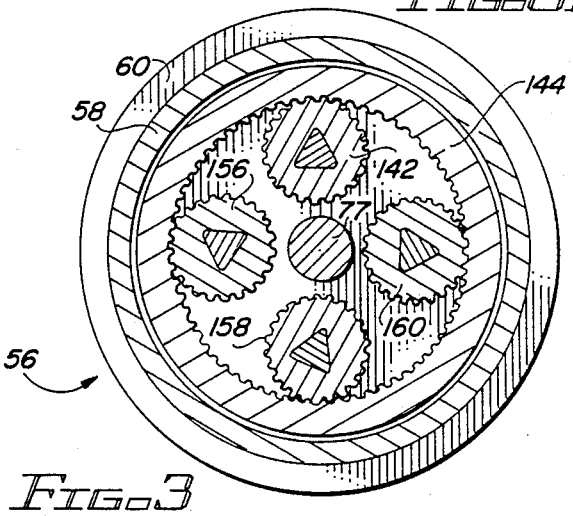
FIG. 3

FIG. 11
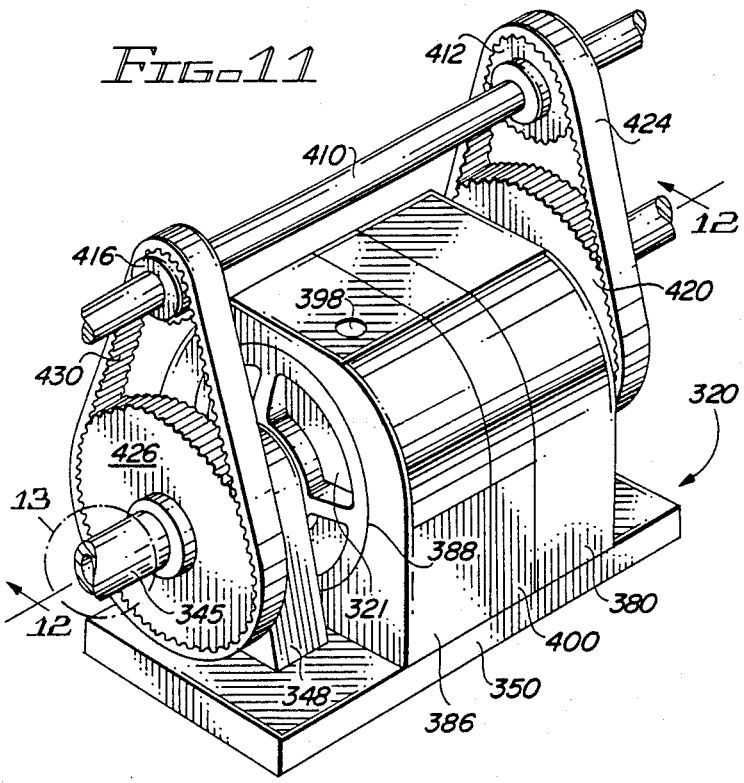
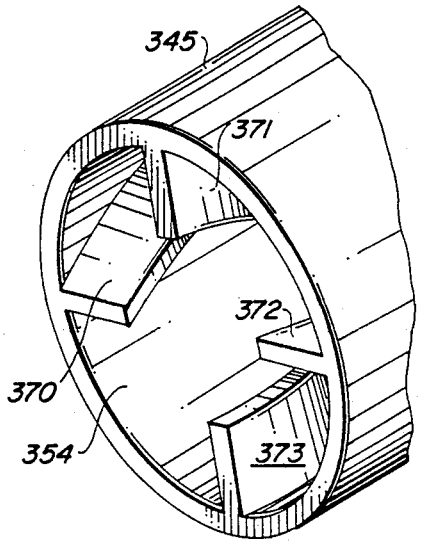
FIG. 13
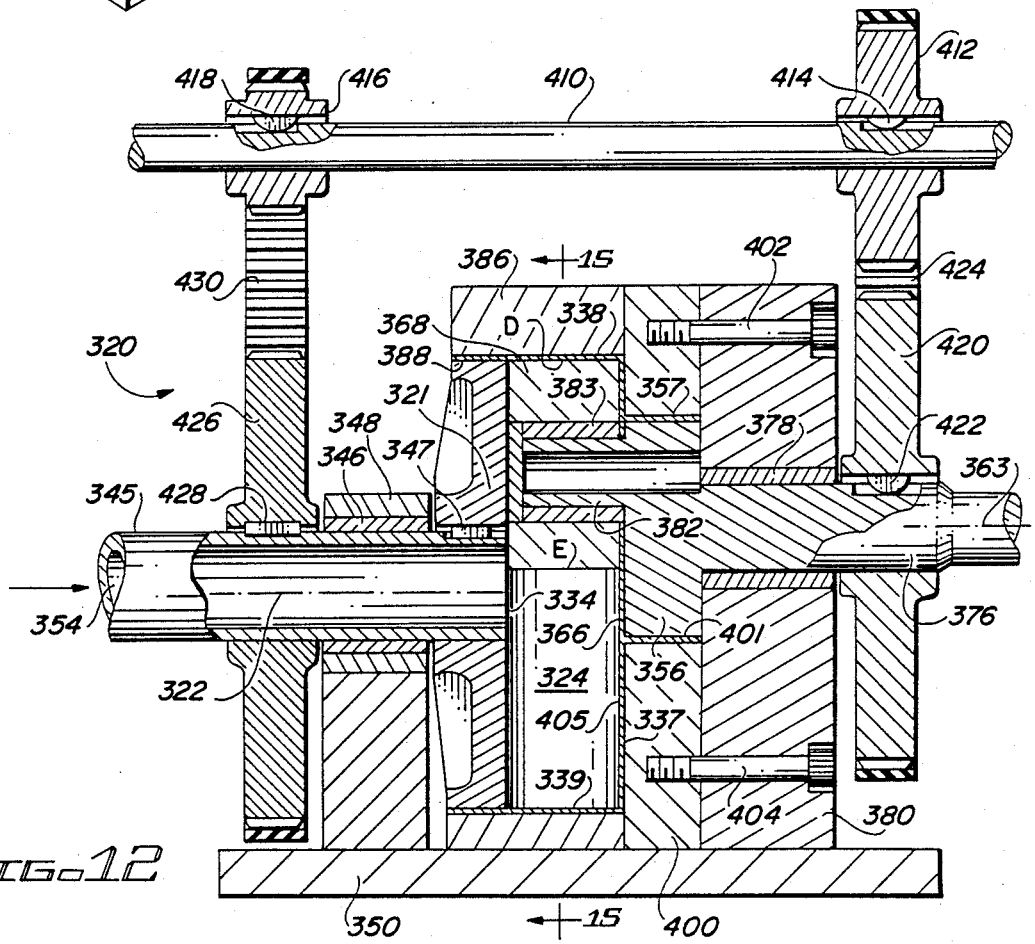
FIG. 12

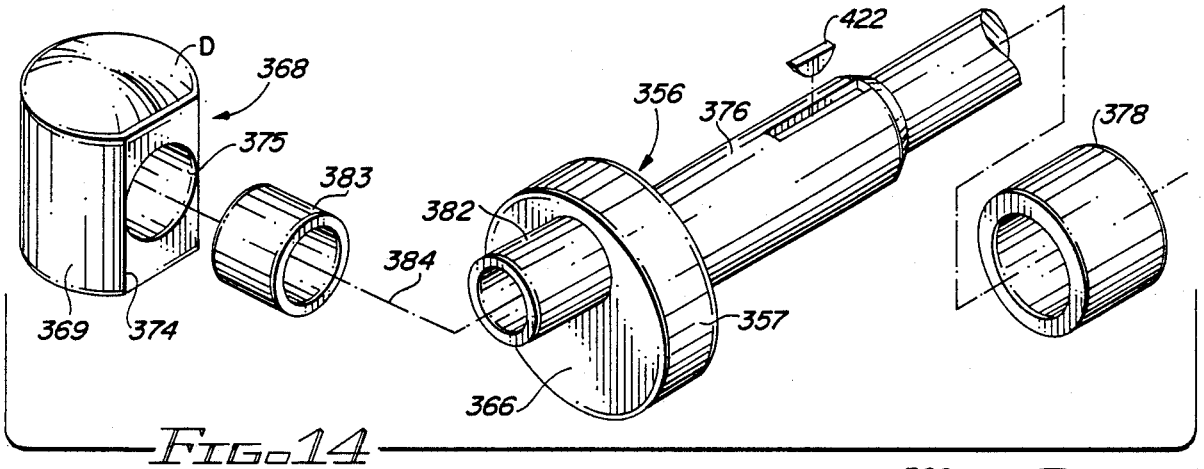
FIG. 14
FIG. 15
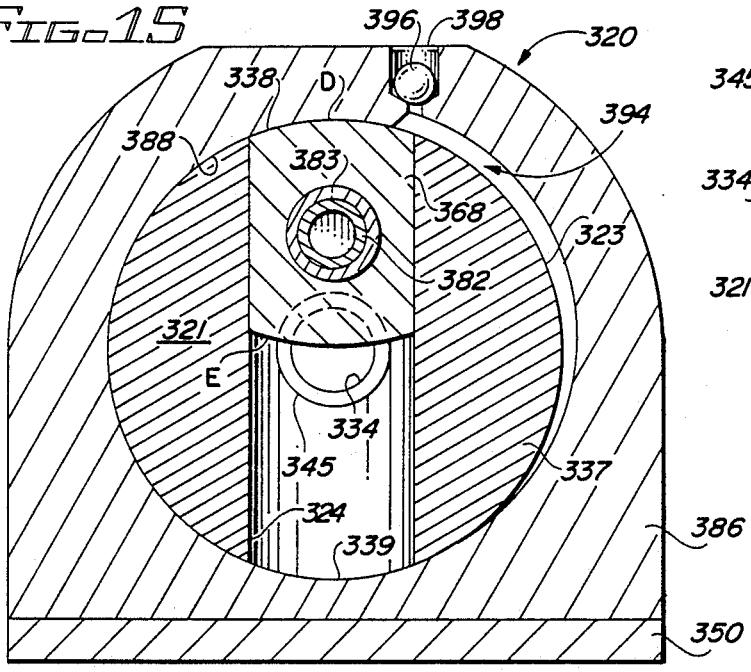
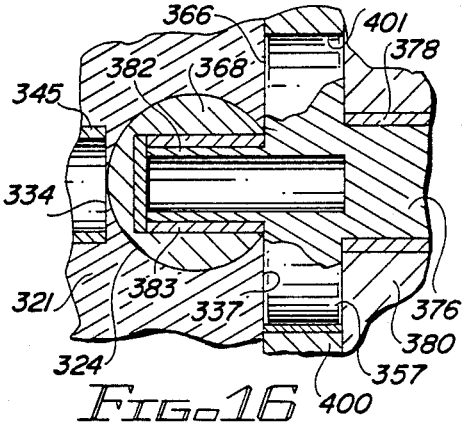
FIG. 16
FIG. 17A FIG. 17B FIG. 17C FIG. 17D
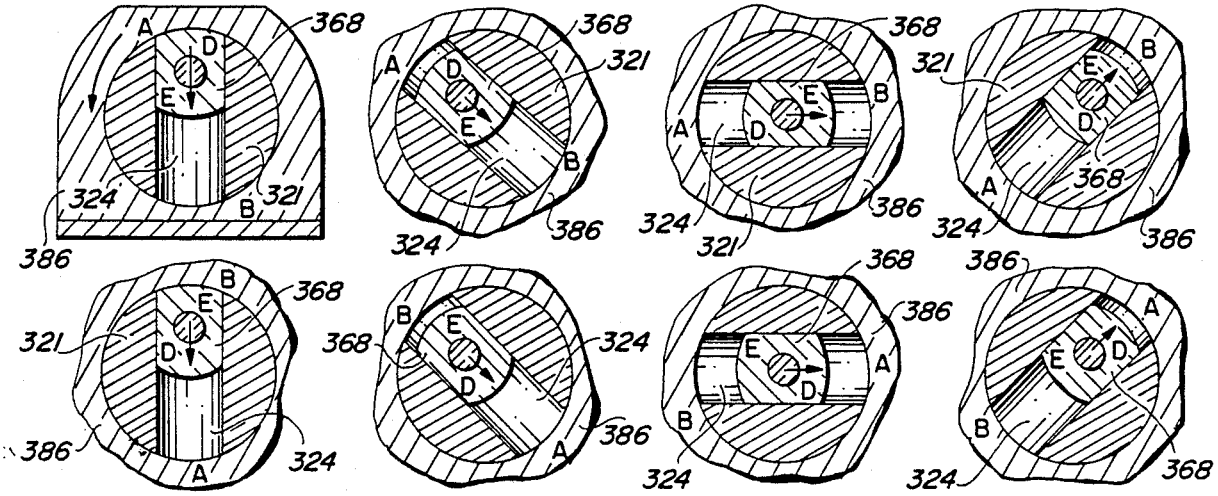
FIG. 17E FIG. 17F FIG. 17G FIG. 17H

PURE ROTARY POSITIVE DISPLACEMENT DEVICE

BACKGROUND OF THE INVENTION

1. Field of the Invention

The present invention relates generally to positive displacement devices, for example devices using pistons in cylinders such as pumps, compressors, expanders and internal and external combustion engines, and more particularly, to positive displacement devices using purely rotary movement.

2. Description of the Prior Art

A wide variety of positive-displacement pumps are known in the art for pumping liquids and compressing gases. For example, a number of positive-displacement pumps are shown and described by Wilson, "Positive-Displacement Pumps", Product Engineering, Jun. 6, 1960, pages 42–51. Many such pumps develop rotary motion to displace the liquid being pumped, but such "rotary" motion is often eccentric, orbital, or accompanied by linear reciprocal motion. Such motions limit the speed and efficiency at which such positive-displacement pumps can be operated. Excessive speeds result in unacceptable vibration and rapid wear.

U.S. Pat. No. 1,599,778 issued to Loftus discloses a metering pump for pumping fluids and includes a rotor having an even number of radial slots extending from the center of the rotor and terminating near the rim thereof. A series of rollers are secured to a rotatable disk, the rollers being designed to fit closely within the radial slots of the rotor. The disk carrying the rollers is offset from the center of the rotor, and the centers of the rollers pass through the center of the rotor. The fluid to be pumped is drawn into the device from an inlet chamber in communication with peripheral ports formed near the rim of the rotor at each radial slot. Fluid is discharged from the pump either by a pipe connected to the center of the rotor or by an outlet chamber in communication with the peripheral port at the end of each rotor adjacent the rim thereof.

The metering pump disclosed in the '778 Loftus patent uses pure rotary motion. However, by admitting the fluid to be pumped into the peripheral ends of the radial slots formed in the rotor, the pump disclosed by Loftus is not efficient at high speed operation. Centrifugal force developed by the rotating motion of the device acts against fluid attempting to enter the peripheral end of the radial slot. Clearly, the aforementioned centrifugal force developed by the rotation of the rotor opposes the partial vacuum created by the pistons as they move away from the peripheral end of the radial slots while passing by the inlet chamber.

Additionally, in the apparatus disclosed by the '778 Loftus patent, the rolling motion of the roller disk can engage only one side of the radial slot at any moment in time, thus leaving a gap for the leakage of fluids on the side of the roller disk not contacting the wall of the radial slot. If there were a true "sliding seal" formed between the roller and both side walls of the radial slot, then the claimed roller motion could not actually be achieved. Thus, the amount of pressure or compression which can be obtained from such a structure is significantly limited.

Furthermore, the pump disclosed by the '778 Loftus patent does not include any mechanism for synchronizing the rotation of the rotor and the roller disk; instead, the rolling force of the rollers bearing against the walls of the radial slots causes the rotor to advance. Over time, the constant pressure exerted by the rollers against the side walls of the radial slots causes wear which continually increases leakage between the side walls of the pistons and the mating side walls of the radial slots.

In addition, the rollers disclosed by the '778 Loftus patent are cylindrical in cross-sectional shape and develop only a line contact between the periphery of the roller and the side walls of the radial slot. Accordingly, and at best, only a sliding line seal is maintained between the rollers and the walls of the radial slot, as compared with the conjugate surface seal of a conventional piston and cylinder commonly used in reciprocating piston pumps and compressors. The line contact developed by the cylindrical rollers disclosed by Loftus limits the vacuum which can be developed by such a pump and is not as effective in maintaining a fluid-tight seal between the roller and the side walls of the radial slot as is a device which has working elements having conjugate surfaces that wipingly engage each other.

Apart from rotary motion pumps, rotary motion internal combustion engines are also well known. For example, the Wankle rotary internal combustion engine is known to those in the art of engine design and has been somewhat successful in the marketplace. U.S. Pat. No. 1,166,999, issued to Loftus, discloses an explosive engine having a structure similar to that disclosed in the aforementioned '778 Loftus patent. A series of rollers are supported for rotation by a pinion, and the rollers mesh with elongated radial slots formed in a rotating rim eccentric to the pinion. A spark plus is fitted within an ignition port to ignite explosive gases compressed by a roller that had advanced within a radial slot. However, this device suffers from the same disadvantages as described above in regard to the '778 Loftus patent.

Accordingly, it is an object of the present invention to provide a pure rotary positive displacement device which will function in any application which utilizes a piston and a cooperating cylinder and which will pump, compress, or expand a fluid as described above, but wherein the admission of the fluid to be pumped, compressed or expanded is admitted to one or more of such cylinders at a point other than its peripheral end to avoid the necessity of overcoming centrifugal force in order to fill each cylinder with such fluid.

It is another object of the present invention to provide such a pure rotary positive displacement device wherein the rotational movement of the rotor or cylinder housing, and the piston or pistons, are synchronized for maintaining the movement of the pistons along the center lines of the cylinders to minimize friction therebetween and to minimize wear of such components.

It is still another object of the present invention to provide such a pure rotary positive displacement device which utilizes one or more pistons which may be other than cylindrical in shape and which increase the area of the sliding seal contact between the side walls of the pistons and the mating side walls of the cylinders to minimize leakage and achieve greater compression.

It is yet another object of the present invention to provide such a pure rotary positive displacement device which may be constructed as a highly compact device and which may be operated at relatively high speeds to provide a sizeable flow rate.

These and other objects of the present invention will become more apparent to those skilled in the art as the description thereof proceeds.

Because the shapes of the working elements in this invention are unusual with respect to what is common in the art, it is necessary that clear definitions be established. A cylinder is a passageway for a piston, but in this invention, such cylinders are not necessarily circular in cross section, but may also be rectangular, elliptical or any other useful shape. A cylinder extends radially outward from the center of its housing, and always has a corresponding opposing cylinder on the same centerline at 180 degrees thereto. Thus the cylinders are always even in number, with a minimum of two. When only two cylinders are used, the two radial cylinders effectively merge with each other to form a single cylinder which extends diametrically through the cylinder housing. Preferably, a piston has, in cross section, the same shape as the cylinder in which it moves. The number of pistons is usually one half the number of cylinders. In this invention, rotating pistons and cylinders are analogous to conventional reciprocating pistons and cylinders in function.

SUMMARY OF THE INVENTION

Briefly described, and in accordance with one embodiment thereof, the present invention relates to a pure rotary positive displacement device which will function in any application which utilizes a piston or pistons, and one or more cooperating cylinders, and which will pump, compress, or expand a fluid, and includes a cylinder housing having a central rotational axis, and an arcuate peripheral surface, the cylinder housing including one or more cylinders extending radially from its center toward the arcuate peripheral surface thereof. Each cylinder has an opening communicating with a front face of the cylinder housing. Openings are formed in the peripheral surface of the cylinder housing communicating with an end of the cylinder for permitting fluid to be exchanged between each cylinder and a point external thereto. The device further includes a piston carrier having a central rotational axis and, preferably, a planar sealing face adapted to form a seal with the front face of the cylinder housing. The cylinder housing and piston carrier are mounted for rotation adjacent to one another, and the central rotational axis of the piston carrier extends parallel to, but offset from, the central rotational axis of the cylinder housing. The piston carrier and cylinder housing rotate in the same direction, the piston carrier rotating at two times the rotational speed of the cylinder housing. One or more pistons are secured to the piston carrier and extend into the cylinder housing for movement back and forth along the cylinders as the piston carrier and cylinder housing rotate together. Each piston is spaced from the central rotational axis of the piston carrier by the offset between the central rotational axis of the piston carrier and the central axis of the cylinder housing.

In one embodiment of the present invention, a single piston is used. A bore extends substantially through the cylinder housing perpendicular to and extending through the central rotational axis thereof to provide a substantially continuous cylinder within which the piston slides. The cylinder extends between first and second ends, and openings formed in the arcuate peripheral surface of the cylinder housing communicate with each end of the cylinder. The piston is rotatably secured to the piston carrier and slides within the cylinder substantially between the first and second ends thereof as the piston carrier and cylinder housing rotate together. The cross-sectional shape of the piston, as taken through a plane perpendicular to the rotational axis of the piston is preferably non-circular to maximize surface contact area between the side walls of the piston and the side walls of the cylinder. The piston carrier rotates at twice the rotational speed of the cylinder housing. Synchronization gears can be provided to synchronize the rotation of the piston carrier with the rotation of the cylinder housing and thereby minimize the wear of the piston against the cylinder. To form a compressor or pump, a fluid inlet is provided to introduce fluid into the cylinder, and a stationary cylinder head is provided adjacent the arcuate peripheral surface of the cylinder housing in sealing engagement therewith to receive fluid pumped or compressed by the piston as the piston alternately advances toward the first and second ends of the cylinder.

In an alternate embodiment, two or more pistons are rotatably secured to the piston carrier equiangularly spaced from one another and each spaced from the central rotational axis of the piston carrier by the offset between the central rotational axis of the piston carrier and the central rotational axis of the cylinder housing. The cylinder housing includes four or more cylinders each extending radially from its center toward the arcuate peripheral surface thereof. The cylinders are equiangularly spaced from each other and each cylinder has an opening communicating with the front face of the cylinder housing. When operated as a pump or compressor, discharge or exhaust openings are formed in the arcuate peripheral surface of the cylinder housing communicating with the distal end of each of the cylinders for discharging or exhausting fluid therefrom. The piston carrier has a planar sealing face adapted to form a seal with the front face of the cylinder housing. The cylinder housing and piston carrier are mounted for rotation adjacent to one another in the same rotational direction. The number of pistons is one-half the number of cylinders, and the pistons extend into the cylinder housing for movement back and forth along the cylinders as the piston carrier and cylinder housing rotate together.

When the rotary positive displacement device of the present invention is used as a fluid pump or compressor, a fluid admitting mechanism is provided for delivering a fluid from a source thereof to the central portion of the cylinder housing, thereby allowing such fluid to fill the cylinders from the proximal ends thereof closest to the central portion of the cylinder housing. A stationary cylinder head forms a sliding seal with a portion of the arcuate peripheral surface of the cylinder housing for communicating with the exhaust openings formed at the distal ends of each of the cylinders for expelling the fluid pumped or compressed as each of the pistons advances toward the distal end of one of the cylinders. Alternatively, if the rotary positive displacement device of the present invention is used as a fluid motor, the pressurized fluid may be admitted through the stationary cylinder head into the distal ends of the cylinder, and may be exhausted from the cylinders within the central portion of the cylinder housing.

In one preferred embodiment of the present invention, synchronization between the cylinder housing and piston carrier is maintained by a first gear secured to the cylinder housing and a second gear secured to the piston carrier and engaged with the first gear. The first gear includes twice the number of gear teeth as the second gear for permitting the piston carrier to rotate at twice the rotational speed of the cylinder housing. Such synchronization of rotational movement between the cylinder housing and the piston carrier maintains the pistons properly aligned with the center line of each cylinder and lessens the wear exerted by the side walls of the pistons upon the side walls of the cylinders. Preferably, the first gear is an internal ring gear secured to the cylinder housing, and the second gear is a pinion secured to the piston carrier and disposed within the internal ring gear in engagement therewith.

In another preferred embodiment of the present invention, the pistons are each configured to maximize the common surface area between the side walls of each piston and the side walls of an associated cylinder. Accordingly, each piston is rotatably mounted to the piston carrier by a piston shaft, and each such piston shaft has a pinion fixedly secured thereto. Each of the pinions simultaneously engages a floating, free-wheeling synchronizing gear which permits the pistons to rotate while locking in place their relative angular orientation with respect to each other and causing the pistons to move at the same rotational speed about their rotational axes.

When two or more pistons are used, the piston carrier is preferably composed of a front plate facing the cylinder housing and a rear plate connected to the front plate and defining an enclosed space therebetween. Each of the piston shafts extends through aligned holes formed in the front and rear plates of the piston carrier for rotation therein. The pinions are disposed within the aforementioned enclosed space between the front and rear plates of the piston carrier, and the synchronizing gearing is also disposed within such enclosed space in engagement with the pinions. The synchronizing gearing may be in the form of an internal ring gear, and the pinions may each be disposed within and engaged with the internal ring gear.

BRIEF DESCRIPTION OF THE DRAWINGS

FIG. 1 is a cross-sectional view of a pure rotary positive displacement device including a floating internal ring gear and a series of mating pinion gears for coordinating angular rotational movements of a series of pistons which travel within a cylinder housing.

FIG. 2 is a cross-sectional view of the pure rotary positive displacement device show in FIG. 1 taken through the plane designated by lines 2—2 in FIG. 1 and showing the cross-sectional shape of the pistons and their movement within eight radially-extending cylinders formed within a cylinder housing.

FIG. 3 is a cross-sectional view taken through the plane designated by lines 3—3 in FIG. 1 and depicting a floating, free-wheeling internal ring synchronizing gear housed within a piston carrier and engaged with four pinion gears for coordinating the angular movements of the four pistons.

FIG. 4 is a front view of one of the pistons shown in FIG. 2 and illustrating the attachment of such piston to its piston shaft.

FIGS. 6A, 6B, 6C and 6D are simplified schematic views of a pure rotary positive displacement device having three pistons and illustrating the sequence of movements of the pistons within the associated cylinders as the cylinder housing and piston carrier rotate together.

FIG. 11 is a perspective view of a single-piston embodiment of the present invention including timing pulleys and timing belts for synchronizing rotational motion of a cylinder housing with the rotational motion of a piston carrier.

FIG. 12 is a sectional view of the pure rotary positive displacement device shown in FIG. 11 taken through lines 12—12 as shown in FIG. 11.

FIG. 13 is a detailed perspective view of the end portion of a driven shaft rotatably supporting the cylinder housing as designated by the dashed circle 13 within FIG. 11, and illustrating fluid vanes for drawing air or another working fluid inwardly into the cylinder housing as the cylinder housing rotates.

FIG. 14 is an exploded perspective view of the piston and piston carrier shown in FIG. 12.

FIG. 15 is a sectional view of the pure rotary positive displacement device taken through lines 15—15 as shown in FIG. 12 and illustrating a stationary cylinder head forming a sliding seal with the cylinder housing.

FIG. 16 is a horizontal sectional view taken through the cylinder housing, and through the piston and piston carrier shown in FIG. 12.

FIGS. 17A–17H are simplified sectional views corresponding to that shown in FIG. 15 and illustrating, in stepwise fashion, the movement of the piston through the cylinder as the cylinder housing and the piston carrier rotate together.

Detailed Description of the Drawings

Figure 5:
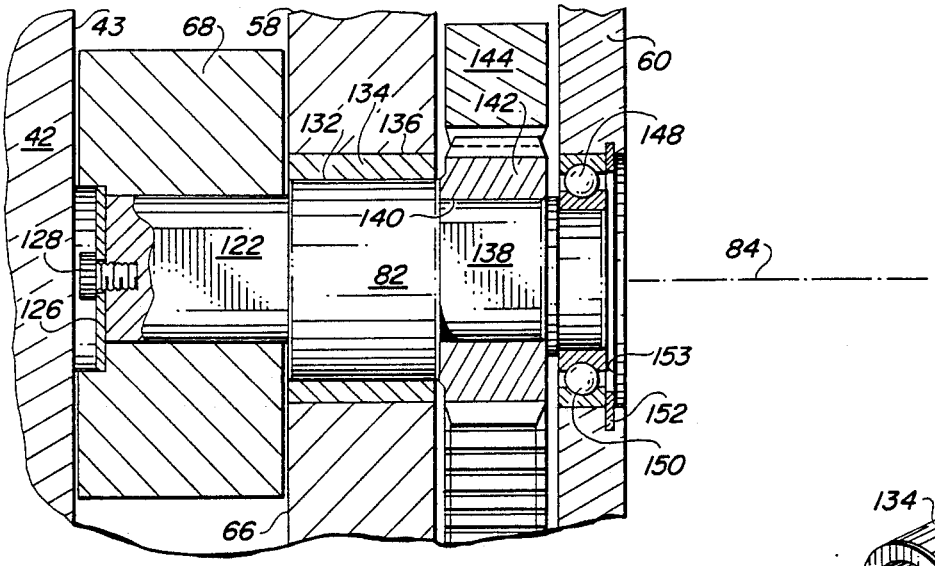
FIG. 5 is a detailed sectional view of one of the pistons shown in FIG. 1, as well as the related portion of the piston carrier supporting such piston.

A pure rotary positive displacement device constructed according to the teachings of the present invention is shown in FIG. 1 and is designated generally by reference numeral 20. Positive displacement device 20 includes a circular cylinder housing 21 having a central rotational axis shown by the dashed line designated by reference number 22. Cylinder housing 21 includes an arcuate peripheral surface 23. As shown best in FIG. 2, eight cylinders 24, 25, 26, 27, 28, 29, 30 and 31 are formed within cylinder housing 21, each extending radially from a proximal end, such as proximal end 32 for cylinder 26, to a distal end near arcuate peripheral surface 23, such as distal end 36 of cylinder 26. The proximal ends of each of the eight cylinders all open in common to a central portion 34 of cylinder housing 21. While eight cylinders are shown in FIG. 2, the number of such cylinders may be any even number. As shown in FIG. 2, the eight radial cylinders 24–31 are spaced equiangularly at 45 degree angular intervals from each other. Each of the cylinders 24–31, as well as central region 34, of cylinder housing 21 is open along the front face 37 of cylinder housing 21. Front face 37 is substantially planar and lies perpendicular to central rotational axis 22.

As shown in FIGS. 1 and 2, each radial cylinder includes a fluid discharge passage extending from the distal end of the cylinder to an exhaust opening formed in arcuate peripheral surface 23 of cylinder housing 21.

For example, cylinder 24 includes fluid discharge passage 38 communicating with exhaust opening 40, while cylinder 28 includes fluid discharge passage 39 extending from the distal end of cylinder 28 to exhaust opening 41.

Cylinder housing 21 is supported by a circular carrier plate 42. The front face 43 of carrier plate 42 is substantially planar and can serve as the rear wall of the various cylinders. The central portion 44 of carrier plate 42 has an axial bore 52 formed therein into which shaft 45 extends. Shaft 45 is rotatably mounted in a bearing 46 which is in turn supported in the upper end of a vertical standard 48, the lower end of which is mounted to a base 50. Accordingly, standard 48, bearing 46, shaft 45, and support plate 42 collectively form a cylinder housing carrier for supporting cylinder housing 21 for rotation about central rotational axis 22. As shown in FIG. 1, shaft 45 may have an axial bore 54 formed therein which opens into central portion 34 of cylinder housing 21 for supplying a fluid to be pumped or compressed by positive displacement device 20. In this event, a source of the fluid to be pumped or compressed may be coupled to the leftmost open end of shaft 45 or to the left face of standard 48 with respect to FIG. 1.

Positive displacement device 20 further includes a piston carrier designated generally by reference numeral 56 in FIG. 1. Within the embodiment of the present invention shown in FIG. 1, piston carrier 56 is formed by two circular plates including a front plate 58 and a rear plate 60. Front plate 58 includes a substantially planar sealing face 66 adapted to form a sliding seal with front face 37 of cylinder housing 21, as shown in FIG. 1. Piston carrier 56 has a central rotational axis shown in FIG. 1 by the dashed lines designated by reference numeral 63, and planar sealing face 66 extends substantially perpendicular thereto. Extending from and supported by piston carrier 56 are a series of four pistons 68, 70, 72 and 74. As shown in FIGS. 1 and 2, pistons 68–74 extend within cylinder housing 21 for movement into and out of radial cylinders 24–31 as piston carrier 56 and cylinder housing 21 rotate together. The number of such pistons is equal to one-half the number of radial cylinders, and accordingly, the selection of a cylinder housing 21 having eight cylinders results in the use of four pistons. The manner in which the pistons are arranged and spaced about piston carrier 56 is described in greater detail below.

Piston carrier 56 is rotatably supported by piston carrier drive shaft 76 which is centered about the central rotational axis 63 of piston carrier 56. Drive shaft 76 is keyed to rear plate 60 by key 81 and includes an end portion 77 which extends through a central bore within front plate 58 to which it is keyed and an aligned central bore within rear plate 60 of piston carrier 56. Drive shaft 76 is rotatably mounted within bearing 78 which is in turn supported by the upper end of a vertical standard 80, the lower end of which is also secured to base 50. As shown in FIG. 1, drive shaft 76, bearing 78, and standard 80 collectively provide a piston carrier support for supporting piston carrier 56 for rotation about central rotational axis 63, while simultaneously positioning planar sealing face 66 of piston carrier 56 parallel and adjacent to the front face of cylinder housing 21. As shown in FIG. 1, central rotational axis 63 of piston carrier 56 is offset by a predetermined distance from central rotational axis 22 of cylinder housing 21.

Referring collectively to FIGS. 1, 2, 5 and 7, each of the four pistons 68–74 is secured by a piston shaft which rotates within plates 58 and 60 of piston carrier 56. For example, piston 68 is fixedly mounted to piston shaft 82 for rotation about an axis of rotation 84 (see FIG. 5) which extends parallel to the central rotational axis 63 of piston carrier 56. The central axes of rotation for pistons 68, 70, 72 and 74 are spaced equiangularly about central rotational axis 63 of piston carrier 56, and the axis of rotation for each piston shaft is offset from central rotational axis 63 of piston carrier 56 by the same predetermined distance separating central rotational axis 63 of piston carrier 56 from central rotational axis 22 of cylinder housing 21.

Still referring to FIGS. 1 and 2, a stationary cylinder head 86 is shown having a curved lowermost sealing surface 88 extending over and around, and disposed adjacent to, the arcuate peripheral surface 23 of cylinder housing 21 to form a sliding seal therewith. A series of grooves such as those designated by reference numerals 90 and 92 are preferably formed within the sealing surface 88 to create turbulence with the boundary layer of fluid disposed between cylinder head 86 and cylinder housing 21 to provide a more effective seal therebetween. Cylinder head 86 includes an exhaust chamber 94 which rises above the arcuate peripheral surface 23 of cylinder housing 21 and communicates with a check valve 96. Check valve 96 permits pressurized fluid within exhaust chamber 94 to exit through discharge passage 98 to a point of use, while preventing pressurized fluid above check valve 96 from flowing back into exhaust chamber 94. As will be explained in greater detail below, stationary cylinder head 86 and exhaust chamber 94 formed therein communicate with exhaust opening 38 and the exhaust openings of the other cylinders for releasing fluid pumped or compressed by pistons 68–74 as each piston advances toward the distal end 36 of each cylinder.

Figure 7:
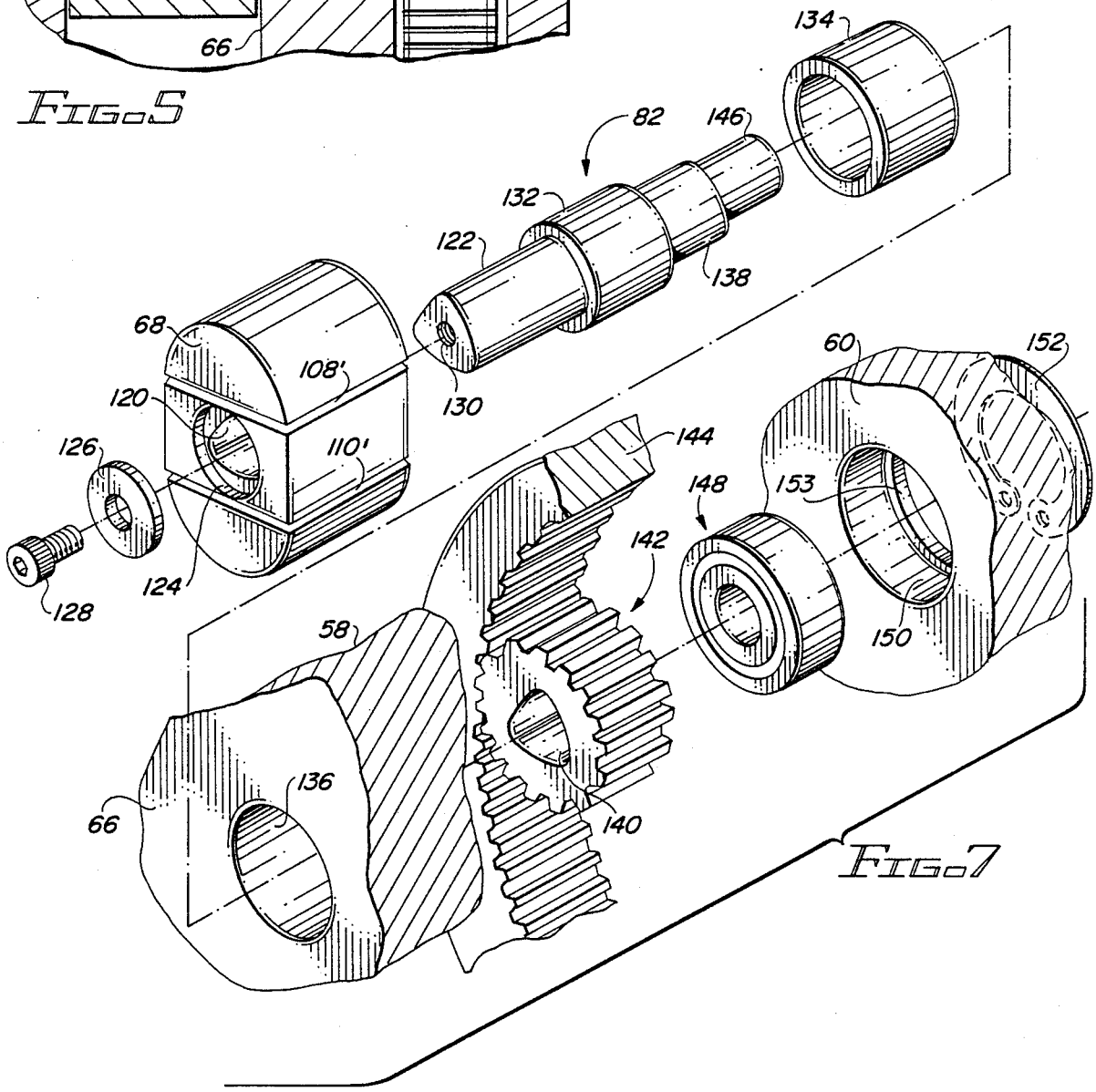
FIG. 7 is an exploded view of the piston, piston shaft, and piston carrier shown in FIG. 5.

As mentioned earlier, one of the objects of the present invention is to permit the use of pistons which are shaped other than as rollers for allowing a significant amount of surface area overlap between side walls of the pistons and side walls of the cylinders, thereby increasing compression and minimizing fluid leakage around the pistons. As shown in the embodiment of the invention illustrated in FIGS. 1–5 and 7, pistons 68–74 each have a cross-sectional shape, when sectioned by a plane extending perpendicular to the axis of rotation of each such piston, in the form of a rectangular center section, including straight, smooth opposing side walls 100 and 102, and terminating in rounded, convex opposing piston head portions 104 and 106, as shown in FIG. 4 for piston 72. While head portions 104 and 106 of piston 72 are shown in FIG. 4 as being convex, they may also be concave, flat or any other desired contour. Elongated side walls 100 and 102 are separated by a width commensurate with the width of the cylinders, thereby causing the side walls of each such piston to wipingly engage the cylinders through which each such piston travels. To further minimize any fluid leakage past the walls of such pistons, the side walls 100 and 102 (see FIGS. 4 and 7) may each include a series of grooves like those designated by reference numerals 108, 110, 112, and 114, again to create turbulence within the thin boundary layer of fluid passing over side walls 100 and 102. As shown in FIGS. 4 and 7, such grooves may extend across the front face of piston 72 for improving the seal between the front face of piston 72 and front face 43 of cylinder housing carrier plate 42.

As mentioned above, the use of pistons having a cross-sectional shape other than circular presents the problem of coordinating the angular orientation of each of the pistons as piston carrier 56 and cylinder housing 21 rotate. For example, referring to FIG. 2, it will be noted that piston 70 is angularly offset from piston 72 by 45 degrees, although the angular spacing between the rotational axes of pistons 70 and 72 relative to central rotational axis 63 of piston carrier 56 is 90 degrees. Thus, for each full rotation of piston carrier 56, each piston rotates through an angle of only 180 degrees. Clearly, synchronization is required in order to insure that, as cylinder housing 21 continues its rotation in a counterclockwise direction, with respect to FIG. 2, piston 72 will smoothly engage cylinder 30 and advance towards its distal end. The manner by which the angular positions of pistons 68–74 are synchronized will now be described.

Referring to FIGS. 5 and 7, piston 68 has a central splined bore 120 formed therein for receiving the splined end 122 of piston shaft 82. A circular countersunk bore 124 is also formed in the front face of piston 68 concentric with splined bore 120 for receiving a retaining washer 126. Allan-head screw 128 passes through a central bore of retaining washer 126 and threadedly engages an internally threaded bore 130 formed in splined end 122 of piston shaft 82 to retain the splined end of piston shaft 82 within piston 68.

Piston shaft 82 includes an enlarged circular boss 132 which rotates within the interior of bushing 134. Bushing 134 is fixedly mounted within bore 136 formed within front plate 58. A further splined portion 138 is formed upon piston shaft 82 opposite splined end 122 for extending within a correspondingly splined bore 140 of pinion 142. The teeth of pinion 142 mesh with the teeth of an internal ring gear 144 that is floating or free-wheeling.

Piston shaft 82 includes a smooth cylindrical end portion 146 opposite splined end 122 which extends within the central bore of ball bearing assembly 148. Ball bearing assembly 148 is mounted within a bore 150 formed within rear plate 60 of piston carrier 56. Retaining ring 152 snaps into groove 153 in plate 60 to retain ball bearing assembly 148 within plate 60.

Referring again to FIG. 1, front plate 58 and rear plate 60 of piston carrier 56 define an enclosed space therebetween. Internal ring gear 144 is positioned within the aforementioned enclosed space and meshes with pinion 142 associated with piston 68. As shown in FIG. 1, pinion 142 and pinions associated with pistons 70, 72 and 74 are also housed within the aforementioned enclosed space. Referring to FIG. 3, pinions 142, 156, 158 and 160 are associated with pistons 68, 70, 72 and 74, respectively. Each of pinions 142, 156, 158 and 160 is engaged with and helps support internal ring gear 144. As shown in FIG. 3, internal ring gear is not connected with or secured to piston carrier 56, but is rather free-wheeling or floating. Thus, internal ring gear 144 serves to synchronize the relative angular orientations of the various pistons, always maintaining such pistons at the same angle as their cooperating cylinders. Moreover, internal ring gear 144 insures that pistons 68–74 all rotate at the same angular speed of rotation. In the presently described example, pistons 68–74 are angularly offset from adjacent following and trailing pistons by 45 degrees. However, when the number of pistons is other than 4, the angular offset between adjacent following and trailing pistons is 180 degrees/N, wherein N is the number of pistons being used.

The actual operation of the positive displacement device shown in FIGS. 1–5 and 7 is as described below: A rotational force is supplied to piston carrier drive shaft 76 causing the same to rotate in a counterclockwise direction, with respect to FIG. 2. The torque applied by piston carrier 56 to pistons 68–74 transfers a rotational force to cylinder housing 21, also causing it to rotate in a counterclockwise direction with respect to FIG. 2. As shown in FIG. 2, piston 74 advances toward the distal end of cylinder 31 as rotation continues, expelling the contents of cylinder 31 into exhaust chamber 94. Further rotation of piston carrier 56 and cylinder housing 21 will ultimately result in piston 74 reaching the distal end of cylinder 31, as represented by the position of piston 68 within cylinder 24. Pressurized fluid within exhaust chamber 94 exits cylinder head 86 through check valve 96 and discharge passage 98. As the distal end of each cylinder passes beyond exhaust chamber 94, the piston therein advances toward central portion 34 of cylinder housing 21, as shown by piston 70 within FIG. 2. This movement continues until the piston has fully exited the cylinder and passes through the central portion 34 of cylinder housing 21, as shown by piston 72 in FIG. 2. The cylinders within the lowermost portion of FIG. 2 are supplied with the fluid to be pumped or compressed through hollow shaft 45 for repeating the cycle as the distal ends of such cylinders again move toward cylinder head 86.

Those skilled in the art will appreciate that the opposing ends of each of pistons 68–74 alternately act as piston heads as such pistons rotate into and out of the cylinders. For example, referring to FIG. 2, continued rotation of piston carrier 56 and cylinder housing 21 will cause rounded end 106 to advance into cylinder 30 and advance toward the distal end thereof. However, when piston 72 next enters a cylinder, rounded end 104 will be the end which is advanced toward the distal end of the cylinder into which piston 72 next advances. Accordingly, the device automatically equalizes wear upon opposing ends of each of the pistons.

FIGS. 6A through 6D demonstrate the above-described motion in schematic form using cylindrical pistons. In FIG. 6A, piston A is at the outermost point at the distal end of cylinder 1 after having fully expelled all fluid initially contained in such cylinder. Piston B is shown as about to exit from cylinder 2, while piston C is shown having just entered cylinder 6.

Within FIG. 6B, the piston carrier has rotated counterclockwise through an angle of approximately 20 degrees from the view shown in FIG. 6A. Piston A has begun its retreat from the distal end of cylinder 1; piston B is just exiting from cylinder 2, while piston C has advanced approximately halfway toward the distal end of cylinder 6.

In FIG. 6C, another schematic view is shown after the piston carrier has rotated approximately 90 degrees counterclockwise from the initial view shown in FIG. 6A. Piston A has retreated approximately halfway from the distal end of cylinder 1. While the piston carrier has rotated approximately 90 degrees from the view shown in FIG. 6A, the cylinder housing has rotated only approximately 45 degrees therefrom. As shown in FIG. 6C, piston B has fully exited cylinder 2 and is about to enter cylinder 5 Piston C is nearing its full travel toward the distal end of cylinder 6.

Finally, in FIG. 6D, the piston carrier is nearing 180 degrees of rotation from the view shown in FIG. 6A, while the cylinder housing is simultaneously nearing 90 degrees of rotation. Piston A is shown about to exit from cylinder 1, while piston B is shown halfway advanced toward the distal end of cylinder 5. Piston C has begun its retreat from the distal end of cylinder 6.

Figure 8:
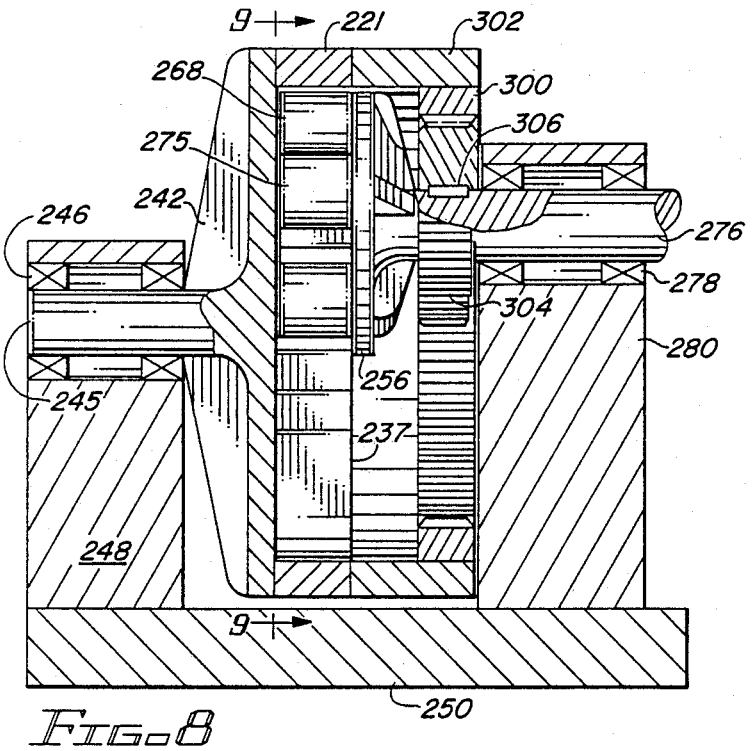
FIG. 8 is an alternate embodiment of a pure rotary positive displacement device using cylindrical pistons and synchronizing gears for synchronizing the rotation of the cylinder housing and the piston carrier.
Figure 9:
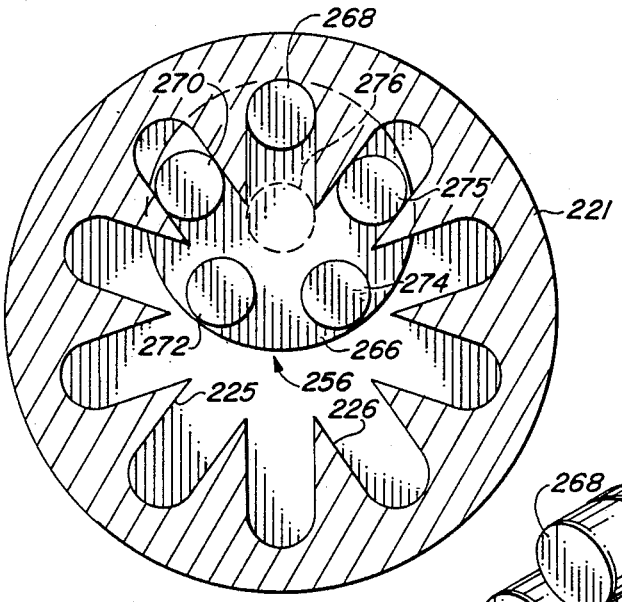
FIG. 9 is a cross-sectional view of the device shown in FIG. 8 taken through the plane designated by lines 9—9, as shown in FIG. 8.
Figure 10:
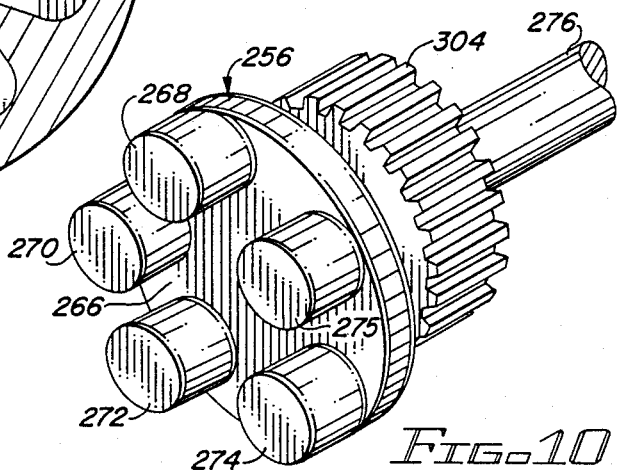
FIG. 10 is a perspective view of the piston carrier, related pistons, pinion, and piston carrier shaft shown in FIG. 8.

It will be recalled that one of the objects of the present invention is to provide a pure rotary positive displacement device which reduces wear by synchronizing the rotation of the piston carrier with the rotation of the cylinder housing to maintain the travel of each piston along the center line of each radial cylinder, thereby reducing wear caused by the force of the piston bearing against the side walls of the cylinders. An emboidment of the present invention utilizing such synchronization between the piston carrier shaft and cylinder housing is shown in FIGS. 8–10. Cylinder housing 221 is rotatably supported by a cylinder housing carrier plate 242 which rotates with a shaft 245 supported by a bearing assembly 246 to the upper end of a vertical standard 248, the lower end of which is supported by a base 250. Cylinder housing 221 includes ten radially extending cylinders, such as those designated by reference numerals 225 and 226. A piston carrier 256 includes a planar sealing face 266 adapted to extend parallel to and adjacent to front face 237 of cylinder housing 221 to form a sliding seal with the upper portion thereof. Piston carrier 256 is secured to drive shaft 276 which is mounted for rotation within bearing assembly 278 which is in turn supported at the upper end of vertical standard 280. For simplicity, the aforementioned stationary cylinder head, discharge passages, and exhaust openings are omitted from FIGS. 8–10, although those skilled in the art will understand that such a stationary cylinder head, discharge passages, and exhaust openings may be provided to form a pump or compressor in the same manner as described above in regard to FIGS. 1–7.

As shown most clearly in FIG. 10, piston carrier 256 includes five cylindrical pistons extending from planar sealing face 266 thereof for movement within the radially extending cylinders of cylinder housing 221. Within FIGS. 8–10, such pistons are designated by reference numerals 268, 270, 272, 274, and 275. Pistons 268–275 are equiangularly spaced about the central longitudinal axis of drive shaft 276 and are spaced therefrom by the same distance at which drive shaft 276 is offset from shaft 245.

To synchronize the rotation of piston carrier 256 with the rotation of cylinder housing 221, an internal ring gear 300 is secured to cylinder housing 221 by a cylinder housing gear support 302. Cylinder housing gear support 302 extends from the periphery of cylinder housing 221 generally around piston carrier 256 and in the same direction in which drive shaft 276 extends from piston carrier 256. A pinion 304 is fixedly mounted to drive shaft 276, as by a key 306 shown in FIG. 8, and is meshed with gear 300. Pinion 304 has exactly one-half the number of teeth provided in internal ring gear 300. As a result, each two full rotations of drive shaft 276 cause internal ring gear 300 to make one full rotation, thereby synchronizing the rotational movement of pistons 268–275 with the rotation of cylinder housing 221, and alleviating excessive side wall pressure of the cylindrical pistons upon the cylinders. Preferably, cylindrical pistons 268–275 are rotatably secured to piston carrier 256 to permit the same to roll within the cylinders of cylinder housing 221. It should be made clear that the rotational force in FIG. 8 is supplied by the gearing and not by transference of force between the piston(s) and the walls of the cylinders.

Within the foregoing description, embodiments of the invention have been described wherein the illustrated apparatus functions as a fluid pump or gas compressor. However, those skilled in the art will appreciate that, by reversing the direction of rotation, by supplying a pressurized fluid to, for example, discharge passage 98 shown in FIG. 2, and by reversing the direction in which check valve 96 acts, a fluid motor is provided whereby the force of the pressurized fluid admitted into the distal ends of each cylinder through chamber 94 of cylinder head 86 pushes the piston away from the distal end of the cylinder, thereby causing both the piston carrier and the cylinder housing to rotate in the direction opposite to that shown in FIG. 2. Similarly, if the piston carrier shown in FIG. 2 is rotated by a motor in the clockwise direction, and if the direction in which check valve 96 acts is reversed, the rotary positive displacement device can serve as a vacuum pump for creating a vacuum at port 98.

FIGS. 11–17 illustrate a further embodiment of the present invention wherein a single piston is utilized to provide a pure rotary positive displacement device. The pure rotary positive displacement device shown in FIGS. 11–17 is designated generally by reference numeral 320 and includes a base 350 supporting a pair of vertically-extending standards 348 and 380. As shown in FIGS. 11 and 12, a stationary cylinder head 386 is also supported upon base 350 adjacent standard 348 and includes a central bore 388 which slidingly receives cylinder housing 321. As shown best in FIG. 12, cylinder housing 321 is supported for rotation by shaft 345 and is locked thereto by a key 347. Shaft 345 is, in turn, supported for rotation by bearing assembly 346 disposed within a bore formed in the upper portion of standard 348. Standard 348, bearing assembly 346, and shaft 345 collectively provide a cylinder housing carrier means for supporting cylinder housing 321 for rotation about its central rotational axis 322. Cylinder housing 321 is circular and has a central rotational axis shown in FIG. 12 by the dashed lines designated by reference numeral 322. Referring to FIG. 15, cylinder housing 321 includes an arcuate peripheral surface 323 which forms a sliding seal with internal bore 388 of stationary cylinder head 386.

As shown in FIGS. 12, 15 and 16, a generally circular bore extends through cylinder housing 321 perpendicular to, and passing through, the central rotational axis 322 of cylinder housing 321 to provide a substantially continuous cylinder 324 extending from a first end 338 to a second opposing end 339. Both first end 338 and second end 339 of cylinder 324 are open along the arcuate peripheral surface 323 of cylinder housing 321. Cylinder housing 321 includes a front face 337 that is substantially planar and lies perpendicular to central rotational axis 322 thereof. As shown best in FIG. 16, cylinder 324 has generally circular side walls and has an opening communicating with front face 337 of cylinder housing 321. The aforementioned opening has the form of an elongated slotted opening extending parallel to cylinder 324 substantially along its length.

When the pure rotary positive displacement device shown in FIGS. 11–17 is to be used as a fluid pump or gas compressor, it is necessary to introduce the fluid to be pumped, or the gas to be compressed, into the aforementioned cylinder 324 formed within cylinder housing 321. For this purpose, shaft 345 may be formed of a hollow tube having an internal bore 354, as shown in FIGS. 11–13. Cylinder housing 321 includes a central axial opening 334 in fluid communication with the internal bore 354 of shaft 345 and in fluid communication with cylinder 324. The opposing end of shaft 345, shown in detail in FIG. 13, is coupled to a source of the fluid to be pumped or the gas to be compressed. Accordingly, if the device is used as an air compressor, the end of shaft 345 shown in FIG. 13 may be left open to the atmosphere. As shown in FIG. 13, internal bore 354 of shaft 345 may have internal vanes formed thereupon, like those designated by reference numerals 370, 371, 372, and 373. Vanes 370–373 are inclined in such a fashion as to force the incoming fluid toward cylinder 324 within cylinder housing 321 as shaft 345 rotates in a counterclockwise direction, relative to FIG. 13. Vanes 370–373 thereby pressurize the incoming fluid as it is delivered to the central portion of cylinder 324.

A dual-headed single piston 368 extends within cylinder 324 for sliding movement therein substantially between first end 338 and second end 339 thereof. As shown in FIGS. 14 and 16, piston 368 has a generally circular side wall 369 of a diameter commensurate with that of cylinder 324. Piston 368 has a flattened side face 374 having a width substantially identical to the width of the slotted opening through which cylinder 324 communicates with the front face 337 of cylinder housing 321. Piston 368 includes a first piston head D and an opposing second piston head E, each of which is shown as being a generally rounded, convex shape, having a degree of curvature corresponding with that of arcuate peripheral surface 323 of cylinder housing 321.

As shown in FIGS. 12 and 14–16, piston 368 includes a circular bore 375 formed therein and extending perpendicularly through flattened side face 374 thereof. A bearing assembly 383 is press-fit within bore 375 of piston 368 and receives piston shaft 382 for rotatably supporting piston 368 about an axis of rotation designated by dashed line 384 in FIG. 14. Piston shaft 382 is shown extending perpendicularly from and integral with a piston carrier 356. Piston carrier 356 is generally circular in shape and includes a circular peripheral surface 357 and a substantially planar front face 366. Piston carrier 356 is adapted to rotate about a central rotational axis represented by dashed lines 363 in FIG. 12. Front face 366 of piston carrier 356 extends substantially perpendicular to central rotational axis 363 and is adapted to contact and form a sliding seal with the front face 337 of cylinder housing 321. Piston shaft 382 extends perpendicular to the front face 366 of piston carrier 356 and parallel to the central rotational axis 363 of piston carrier 356.

Piston carrier 356 is supported for rotation about its central rotational axis 363 by a drive shaft 376 which, as shown in FIGS. 12 and 14, may be integral with piston carrier 356. Drive shaft 376 is rotatably supported by bearing assembly 378 which is, in turn, supported within a cylindrical bore extending horizontally through standard 380. Accordingly, standard 380, bearing assembly 378, and drive shaft 376 collectively constitute a piston carrier support means for supporting piston carrier 356 for rotation about its central rotational axis 363.

Central rotational axis 363 of piston carrier 356 extends parallel to the central rotational axis 322 of cylinder housing 321 and is spaced apart therefrom by a predetermined offset distance. Piston carrier 356 and cylinder housing 321 are designed to be rotated in the same rotational direction as one another. As mentioned above, piston 368 is rotatably secured to piston carrier 356, via bearing assembly 383 and piston shaft 382, along axis of rotation 384. The rotational axis 384 of piston 368 extends parallel to the central rotational axis 363 of piston carrier 356 and is spaced apart therefrom by the same predetermined offset distance that separates the axis of rotation 363 of piston carrier 356 from the central rotational axis 322 of cylinder housing 321. As piston carrier 356 and cylinder housing 321 rotate together, piston 368 slides through cylinder 324 between first end 338 and second end 339 in a manner which will be described below in regard to FIGS. 17A–17H.

As mentioned above, cylinder 324 communicates through an elongated opening formed in the front face 337 of cylinder housing 321 in order to permit piston shaft 382 to extend therethrough. A stationary cover plate 400 is positioned between stationary cylinder head 386 and standard 380, as shown in FIGS. 11 and 12, to form a sliding seal with the front face 337 of cylinder housing 321. Stationary cover plate 400 includes a substantially planar sealing face 405 which extends substantially parallel to and adjacent to front face 337 of cylinder housing 321 to form a sliding seal therewith. Stationary cover plate 400 has a circular bore 401 extending horizontally therethrough and having an internal diameter commensurate with the outer diameter of peripheral surface 357 of piston carrier 356. Piston carrier 356 freely rotates within bore 401 of stationary cover plate 400. When assembled in the manner shown in FIG. 12, sealing face 366 of piston carrier 356 and sealing face 405 of stationary cover plate 400 lie substantially co-planar with each other and seal the elongated opening within front face 337 of cylinder housing 321 that communicates with cylinder 324. As shown in FIG. 12, a pair of threaded bolts 402 and 404 extend through corresponding apertures in standard 380 and are received by aligned threaded apertures in stationary cover plate 400 to secure stationary cover plate 400 and standard 380 together.

Referring to FIG. 15, stationary cylinder head 386 includes a circular internal bore 388 to form a sliding seal with the arcuate peripheral surface 323 of cylinder housing 321. As shown in FIG. 15, internal bore 388 of stationary cylinder head 386 is enlarged along the upper right to provide an exhaust chamber through which fluid that is pressurized or compressed by piston 368 within cylinder 324 can escape, assuming that pure rotary positive displacement device 320 is being used as a fluid pump or gas compressor. As each of the ends 338 and 339 of cylinder 324 passes through exhaust chamber 394, pressurized fluid or compressed gas escapes from the respective end of cylinder 324 into exhaust chamber 394. Exhaust chamber 394 communicates through a check valve 396 with discharge passage 398 for supplying the pumped fluid or compressed gas to a point of use. Check valve 396 normally operates to seal discharge passage 398 from exhaust chamber 394 until the pressure within exhaust chamber 394 exceeds a predetermined minimum pressure.

As mentioned above, the fluid to be pumped, or the gas to be compressed, may be admitted into cylinder 324 through the internal bore 354 of shaft 345, and through central opening 334 of cylinder housing 321. When piston 368 is adjacent the upper portion of stationary cylinder head 386, as shown in FIG. 15, a portion of central opening 334 is exposed for admitting fluid or gas into cylinder 324. Continued rotation of cylinder housing 321 causes piston 368 to advance toward the opposing end 339, thereby sealing central opening 334 until piston 368 has again advanced within cylinder 324 toward the opposing end thereof. Accordingly, internal bore 354 and central opening 334 provide an inlet means for admitting a fluid to be pumped, or a gas to be compressed, into cylinder 324.

Turning now to FIG. 17A–17H, the operation of the single-piston pure rotary positive displacement device will now be explained. For purposes of simplification, exhaust chamber 394 and discharge passage 398 are omitted from the stationary cylinder head 386 shown in FIGS. 17A–17H. Within FIGS. 17A–17H, the reference letters A and B designate first end 338 and second end 339, respectively, of cylinder 324.

Beginning with FIG. 17A, piston 368 is shown in its uppermost position within cylinder 324, with piston head D directed upwardly and piston head E directed downwardly. Cylinder 324 is initially shown in FIG. 17A in its vertical position, with first end A being uppermost, and second end B being lowermost.

In FIG. 17B, cylinder housing 321 has rotated 45 degrees counterclockwise from the initial position shown in FIG. 17A, corresponding to a rotation of 90 degrees counterclockwise for piston carrier 356 (not shown). As shown by the arrow within FIG. 17B, piston 368 has begun to slide within cylinder 324 away from end A and toward end B, whereby piston head E begins to pressurize any fluid within the portion of cylinder 324 lying between piston head E and cylinder end B.

In FIG. 17C, cylinder housing 321 is shown rotated a full 90 degrees counterclockwise from the initial position shown in FIG. 17A, corresponding to a rotation of 180 degrees counterclockwise of piston carrier 356 (not shown). Piston 368 is shown lying within the center of cylinder 324, with piston head E continuing to advance toward cylinder end B. Referring briefly to FIG. 15, it will be appreciated that the circular side walls of piston 368 seal central opening 334 of cylinder housing 321 when piston 368 passes through the central portion of cylinder 324, thereby preventing the escape of pressurized fluid therethrough.

FIG. 17D shows cylinder housing 321 rotated 135 degrees counterclockwise from the initial position shown in FIG. 17A, corresponding to a rotation of 270 degrees of piston carrier 356 (not shown). Piston 368 continues its sliding movement toward cylinder end B, and cylinder head E continues to pressurize fluid trapped within the portion of cylinder 324 lying between piston head E and cylinder end B.

In FIG. 17E, cylinder housing 321 is shown after having made a 180 degree counterclockwise rotation from the starting position shown in FIG. 17A. Piston carrier 356 (not shown) has made a corresponding counterclockwise rotation of 360 degrees. Piston head E has fully advanced to cylinder end B and fully expelled all fluid previously trapped between piston head E and cylinder end B. The central opening 334 of cylinder housing 321 (see FIG. 15) is again opened to admit additional fluid into that portion of cylinder 324 lying between piston head D and cylinder end A.

FIGS. 17F, 17G, and 17H illustrate the continued movement of piston 368 within cylinder 324 as cylinder housing 321 continues its counterclockwise rotation, during which piston head D pressurizes the fluid trapped within cylinder 324 between piston head D and cylinder end A. Those skilled in the art will appreciate that piston 368 alternately advances toward the first end A and toward the second end B of cylinder 324 as cylinder housing 321 and piston carrier 356 rotate together.

As mentioned above, the pure rotary positive displacement device of the present invention may also serve as a vacuum pump or air motor by reversing the direction in which the cylinder housing 321 and piston carrier 356 are rotated, and by reversing the action of check valve 396. Referring to FIG. 15, application of compressed air, for example, to port 398 pressurizes chamber 394, forcing piston 368 to slide through cylinder 324 away from end 338 and toward end 339. Similarly, if an electric motor or other motive force is applied to drive shaft 376 for causing piston carrier 356 to rotate in a clockwise direction, piston 368 is thereby forced away from end 338 of cylinder 324, thereby creating suction within chamber 394, and drawing a vacuum at port 398.

Those skilled in the art will appreciate that the single piston embodiment of the pure rotary positive displacement device shown in FIGS. 11–17 is analogous to the multiple piston embodiment of the present invention shown in FIGS. 1–10, except that two oppositely directed radial cylinder sections have been joined together at the center of the cylinder housing to form a single continuous cylinder adapted to receive a single piston. Thus, cylinder 324 may be considered a merged pair of radial cylinder sections, and accordingly, the number of such radial cylinder sections (i.e., two) is twice the number of pistons (i.e., one).

As mentioned above, the circular side walls 369 of piston 368 slide against the circular walls of cylinder 324. To avoid excessive wear between the side walls of piston 368 and cylinder 324, means for synchronizing the rotation of piston carrier 356 and cylinder housing 321 are preferably provided. As shown in FIGS. 11 and 12, such synchronizing means can take the form of a timing pulley and timing belt system which will now be described. Rotating shaft 410 is suitably supported by a bearing assembly (not shown) and extends generally parallel to rotational axis 322 of cylinder housing 321. A first cogged tooth timing pulley 412 is secured about shaft 410 and is locked thereto by a key 414. A second cogged tooth timing pulley 416 is also supported for rotation with shaft 410 and is locked thereto by a key 418. A third cogged tooth pulley 420 is secured about piston carrier drive shaft 376 and is locked for rotation therewith by a further key 422. A first cogged timing belt 424 extends around and is engaged with first pulley 412 and third pulley 420 for transmitting rotational forces therebetween. A fourth cogged tooth timing pulley 426 is secured over cylinder housing carrier shaft 345 and is locked for rotation therewith by key 428. A second cogged timing belt 430 extends around and is engaged with second pulley 416 and fourth pulley 426 for transmitting rotational forces therebetween.

Third pulley 420 has twice the number of teeth as first pulley 412; accordingly, shaft 410 makes two revolutions for each revolution of pulley 420 and, hence, piston carrier drive shaft 376. On the other hand, fourth pulley 426 has four times the number of teeth as second pulley 416, and accordingly, a full revolution of pulley 426, and hence cylinder housing 321, requires four revolutions of shaft 410. Consequently, the angular velocity of piston carrier 356 is twice that of cylinder housing 321, and each revolution of cylinder housing 321 is accompanied by two revolutions of piston carrier 356, thereby maintaining the desired ratio of rotational movement as between such components. Therefore, the side walls of piston 368 need not bear laterally against the side walls of cylinder 324 in order to rotate cylinder housing 321 as the piston carrier 356 is rotated.

Those skilled in the art will now appreciate that an improved pure rotary positive displacement device has been described. While the present invention has been described with reference to several preferred embodiments thereof, the description is for illustrative purposes only and is not to be construed as limiting the scope of the invention. Various modifications and changes may be made by those skilled in the art without departing from the true spirit and scope of the invention as defined by the appended claims.

I claim:

1. A rotary positive displacement device for pumping or compressing a fluid, said rotary positive displacement device comprising in combination:

a. a circular cylinder housing having a central rotational axis and an arcuate peripheral surface, said cylinder housing having a plurality of cylinders formed therein, the number of said cylinders being an even number, each of said cylinders extending radially from a proximal end within a central portion of said cylinder housing toward a distal end proximate said arcuate peripheral surface, said cylinders being equiangularly spaced from each other, said cylinder housing including a substantially planar front face perpendicular to the central rotational axis thereof, each of said cylinders having an opening communicating with the front face of said cylinder housing, each of said cylinders including a fluid discharge passage extending from the distal end of each cylinder to an exhaust opening formed in said arcuate peripheral surface;

b. cylinder housing carrier means for supporting said cylinder housing for rotation about the central rotational axis thereof;

c. a piston carrier having a central rotational axis and having a substantially planar sealing face perpendicular to the central rotational axis thereof;

d. piston carrier support means for supporting said piston carrier for rotation about the central rotational axis thereof, said piston carrier support means supporting the planar sealing face of said piston carrier parallel to and adjacent to the front face of said cylinder housing, the central rotational axis of said piston carrier being offset by a predetermined distance from the central rotational axis of said cylinder housing;

e. at least one piston secured to said piston carrier and extending from the planar sealing face thereof into said cylinder housing for movement into and out of said cylinders as said piston carrier and cylinder housing rotate, the number of said pistons being one-half the number of said cylinders, each piston being spaced from the central rotational axis of said piston carrier by said predetermined distance;

f. inlet means for admitting a fluid to be compressed or pumped into said cylinder housing for supplying fluid to the proximal ends of said cylinders; and g. exhaust means in sealing engagement with said cylinder housing proximate the arcuate peripheral surface thereof and in fluid communication with the exhaust openings formed therein for releasing fluid pumped or compressed by each piston as each piston advances toward the distal end of one of said cylinders.

2. The device described by claim 1 wherein each piston is rotatably mounted to said piston carrier for rotation about an axis parallel to the central rotational axis of said piston carrier.

3. The device described by claim 1 wherein said cylinder housing carrier means includes a rotatably mounted shaft extending along the central rotational axis of said cylinder housing, said rotatably mounted shaft having a fluid passage bore formed therein, and wherein said inlet means includes an opening formed in the central portion of said cylinder housing, said opening being substantially coincident with the central rotational axis of said cylinder housing and in fluid communication with said fluid passage bore for admitting fluid to be compressed or pumped into the central portion of said cylinder housing.

4. The device described by claim 1 wherein said exhaust means includes a stationary cylinder head disposed adjacent the arcuate peripheral surface of said cylinder housing and forming a sliding seal therewith, said cylinder head including a valve for permitting pressurized fluid to be expelled from each of said cylinders as the exhaust opening of each cylinder slides past said stationary cylinder head.

5. The device described by claim 4 wherein said stationary cylinder head includes an arcuate sealing surface forming a sliding seal with the arcuate peripheral surface of said cylinder housing, the arcuate sealing surface having a plurality of grooves formed therein to reduce fluid leakage between said cylinder housing and said stationary cylinder head.

6. The device recited by claim 1 including a plurality of pistons arranged equiangularly about the central rotational axis of said piston carrier.

7. A rotary positive displacement device for pumping or compressing a fluid, said rotary positive displacement device comprising in combination:

a. a circular cylinder housing having a central rotational axis and an arcuate peripheral surface, said cylinder housing having a plurality of cylinders formed therein, the number of said cylinders being an even number, each of said cylinders extending radially from a central portion of said cylinder housing toward a distal end proximate said arcuate peripheral surface, said cylinders being equiangularly spaced from each other, said cylinder housing including a substantially planar front face perpendicular to the central rotational axis thereof, each of said cylinders having an opening communicating with the front face of said cylinder housing, each of said cylinders including a fluid discharge passage extending from the distal end of each cylinder to an exhaust opening formed in said arcuate peripheral surface;

b. cylinder housing carrier means for supporting said cylinder housing for rotation about the central rotational axis thereof;

c. a piston carrier having a central rotational axis and having a substantially planar sealing face perpendicular to the central rotation axis thereof;

d. piston carrier support means for supporting said piston carrier for rotation about the central rotational axis thereof, said piston carrier support means supporting the planar sealing face of said piston carrier parallel to and adjacent to the front face of said cylinder housing, the central rotational axis of said piston carrier being offset by a predetermined distance from the central rotational axis of said cylinder housing;

e. at least one piston secured to said piston carrier and extending from the planar sealing face thereof into said cylinder housing for movement into and out of said cylinders as said piston carrier and cylinder housing rotate, the number of said pistons being one-half the number of said cylinders, each piston being spaced from the central rotational axis of said piston carrier by said predetermined distance;

f. inlet means for admitting a fluid to be compressed or pumped into said cylinders;

g. exhaust means in sealing engagement with said cylinder housing proximate the said arcuate peripheral surface thereof and in fluid communication with the exhaust openings formed therein for releasing fluid pumped or compressed by each piston as each piston advances toward the distal end of one of said cylinders;

h. a first gear coupled to said cylinder housing; and i. a second gear coupled to said piston carrier and coupled to said first gear for synchronizing rotational movement of said cylinder housing with rotational movement of said piston carrier to lessen the wear of said plurality of pistons upon said cylinders.

8. The device recited by claim 7 wherein said first gear has twice the number of teeth as said second gear for permitting said piston carrier assembly to rotate twice for each rotation of said cylinder housing.

9. The device recited by claim 8 wherein said first gear is an internal ring gear having a series of teeth formed upon the interior thereof, and wherein said second gear is a pinion disposed within and engaged with said internal ring gear.

10. The device recited by claim 9 wherein:

a. said piston carrier support means includes a rotatably mounted shaft fixedly coupled to said piston carrier and extending along the central rotational axis thereof in a first direction away from said cylinder housing;

b. a cylinder housing gear support coupled to said cylinder housing and extending from proximate the peripheral surface of said cylinder housing generally toward said first direction and around said piston carrier;

c. said internal ring gear being secured to said cylinder housing gear support; and d. said pinion being fixedly mounted to said rotatably mounted shaft.

11. The device recited by claim 7 wherein each piston is rotatably mounted to said piston carrier for rotation about an axis parallel to the central rotational axis of said piston carrier.

12. The device recited by claim 7 including a plurality of pistons arranged equiangularly about the central rotational axis of said piston carrier.

13. A rotary positive displacement device comprising in combination:

a. a circular cylinder housing having a central rotational axis and an arcuate peripheral surface, said cylinder housing having at least four cylinders formed therein, the number of said cylinders being an even number, each of said cylinders extending radially from a central portion of said cylinder housing toward a distal end proximate said arcuate peripheral surface, said cylinders being equiangularly spaced from each other, said cylinder housing including a substantially planar front face perpendicular to the central rotational axis thereof, each of said cylinders having an opening communicating with the front face of said cylinder housing;

b. cylinder housing carrier means for supporting said cylinder housing for rotation about the central rotational axis thereof;

c. a piston carrier having a central rotational axis and having a substantially planar sealing face perpendicular to the central rotational axis thereof;

d. piston carrier support means for supporting said piston carrier for rotation about the central rotational axis thereof, said piston carrier support means supporting the planar sealing face of said piston carrier assembly parallel to and adjacent to the front face of said cylinder housing, the central rotational axis of said piston carrier being offset by a predetermined distance from the central rotational axis of said cylinder housing;

e. a plurality of pistons each rotatably secured to said piston carrier about an axis of rotation parallel to the central rotational axis of said piston carrier, said plurality of pistons extending into said cylinder housing for movement into and out of said cylinders as said piston carrier and cylinder housing rotate, the number of said plurality of pistons being one-half the number of said cylinders, said plurality of pistons being spaced equiangularly about the central rotational axis of said piston carrier and being spaced from the central rotational axis of said piston carrier by said predetermined distance, each of said pistons having a cross-sectional shape when sectioned by a plane extending perpendicular to the axis of rotation thereof, which cross-sectional shape is other than circular;

f. a synchronizing gear, said synchronizing gear being rotatable with respect to said piston carrier; and g. a plurality of pinions, each of said pinions being fixedly connected to one of said pistons, and each of said pinions being engaged with said synchronizining gear for causing said pistons to rotate about their axes of rotation at the same rotational speed as each other.

14. The device recited by claim 13 wherein each of said pistons rotates about its axis of rotation at one-half of the rotational speed at which said piston carrier rotates about its central rotational axis.

15. The device recited by claim 13 wherein each of said pistons has first and second opposing ends, and wherein said first and second ends of each said piston are alternately directed toward the arcuate peripheral surface of said cylinder housing on alternate movements of each said piston within said cylinders.

16. A device as recited by claim 13 wherein said synchronizing gear is a floating internal ring gear, and wherein said plurality of pinions are disposed within and engaged with said floating internal ring gear.

17. A device as recited by claim 13 wherein each of said plurality of pistons is angularly offset with respect to the angular orientation of an adjacent piston, the angular offset being equal to 180°/N, wherein N is the number of said plurality of pistons.

18. A device as recited by claim 13 wherein:

a. said piston carrier includes a front plate including said sealing face, said piston carrier further including a rear plate connected to said front plate and defining an enclosed space therebetween, said front and rear plates having a series of aligned openings equal in number to the number of said plurality of pistons;

b. each of said plurality of pistons has a piston shaft fixedly mounted thereto, each piston shaft extending through and being supported within one of said series of aligned openings in said front and rear plates for rotation therein;

c. said floating internal ring gear is disposed within the enclosed space between said front and rear plates; and d. each of said plurality of pinions is secured to one of said piston shafts and disposed within the enclosed space between said front and rear plates for engaging said floating internal ring gear.

19. A device as recited by claim 18 wherein each of said plurality of pistons has a side wall wipingly engaging said cylinders, the side wall of each of said plurality of pistons having at least one groove formed therein for reducing fluid leakage around the sidewalls of said pistons.

20. A rotary positive displacement device adapted to pump or compress a fluid, comprising in combination:

a. a circular cylinder housing have a central rotational axis and an arcuate peripheral surface, said cylinder housing have a bore extending substantially therethrough perpendicular to the central rotational axis thereof for providing a substantially continuous cylinder, the cylinder having first and second ends, each of the first and second ends of the cylinder including an opening formed through the arcuate peripheral surface of said cylinder housing, said cylinder housing including a front face perpendicular to the central rotational axis thereof, the cylinder having an opening communicating with the front face of the cylinder housing and extending parallel to the cylinder;

b. cylinder housing carrier means for supporting said cylinder housing for rotation about the central rotational axis thereof;

c. a piston carrier having a central rotational axis;

d. piston carrier support means for supporting said piston carrier for rotation about the central rotational axis thereof, the central rotational axis of said piston carrier being offset by a predetermined distance from the central rotational axis of said cylinder housing;

e. a piston rotatably secured to said piston carrier about an axis of rotation and extending within the cylinder for sliding movement therein substantially between the first and second ends thereof as said piston carrier and said cylinder housing rotate, the axis of rotation of said piston being parallel to the central rotational axis of said piston carrier and being spaced apart therefrom by said predetermined distance;

f. inlet means for admitting a fluid to be pumped or compressed into the cylinder; and g. exhaust means in sealing engagement with said cylinder housing proximate the arcuate peripheral surface thereof and in fluid communication with the first and second ends of the cylinder for releasing fluid pumped or compressed by the piston as the piston alternately advances toward the first end and toward the second end of the cylinder, said exhaust means including a stationary cylinder head disposed adjacent the arcuate peripheral surface of said cylinder housing and forming a sliding seal therewith, said cylinder head including a valve for permitting pressurized fluid to be alternately expelled from the first end and the second end of the cylinder as the first and second ends of the cylinder slide past said stationary cylinder head.

21. A rotary positive displacement device comprising in combination:

a. a circular cylinder housing have a central rotational axis and an arcuate peripheral surface, said cylinder housing have a bore extending substantially therethrough perpendicular to the central rotational axis thereof for providing a substantially continuous cylinder, the cylinder having first and second ends, each of the first and second ends of the cylinder including an opening formed through the arcuate peripheral surface of said cylinder housing, said cylinder housing including a front face perpendicular to the central rotational axis thereof, the cylinder having an opening communicating with the front face of the cylinder housing and extending parallel to the cylinder;

b. cylinder housing carrier means for supporting said cylinder housing for rotation about the central rotational axis thereof;

c. a piston carrier having a central rotational axis;

d. piston carrier support means for supporting said piston carrier for rotation about the central rotational axis thereof, the central rotational axis of said piston carrier being offset by a predetermined distance from the central rotational axis of said cylinder housing;

e. a piston rotatably secured to said piston carrier about an axis of rotation and extending within the cylinder for sliding movement therein substantially between the first and second ends thereof as said piston carrier and said cylinder housing rotate, the axis of rotation of said piston being parallel to the central rotational axis of said piston carrier and being spaced apart therefrom by said predetermined distance; and f. synchronizing means coupled to said cylinder housing and coupled to said piston carrier for synchronizing the rotation of said cylinder housing with the rotation of said piston carrier to reduce wear between said piston and the cylinder, said synchronizing means insuring that said piston carrier rotates at twice the rotational speed of said cylinder housing.

* * * * *